US007827789B2

(12) United States Patent
Welty et al.

(10) Patent No.: US 7,827,789 B2
(45) Date of Patent: Nov. 9, 2010

(54) LINEAR FREE PISTON STIRLING MACHINE

(75) Inventors: Stephen Charles Welty, Cambridge (GB); Andrew Nicholas Hill, Peterborough (GB)

(73) Assignee: Microgen Energy Limited, Berkshire (GB)

( * ) Notice: Subject to any disclaimer, the term of this patent is extended or adjusted under 35 U.S.C. 154(b) by 414 days.

(21) Appl. No.: 11/793,693

(22) PCT Filed: Dec. 21, 2005

(86) PCT No.: PCT/GB2005/004957

§ 371 (c)(1),
(2), (4) Date: Apr. 14, 2008

(87) PCT Pub. No.: WO2006/067429

PCT Pub. Date: Jun. 29, 2006

(65) Prior Publication Data

US 2008/0256945 A1 Oct. 23, 2008

(30) Foreign Application Priority Data

Dec. 22, 2004 (GB) ..... 0428057.4

(51) Int. Cl.
*F01B 29/10* (2006.01)

(52) U.S. Cl. ..... 60/517

(58) Field of Classification Search ..... 60/517–526
See application file for complete search history.

(56) References Cited

U.S. PATENT DOCUMENTS 1,611,755 A * 12/1926 Koenig ..... 60/522
3,782,859 A 1/1974 Schuman
3,788,772 A * 1/1974 Noble et al. ..... 417/207
4,397,155 A 8/1983 Davey et al.
4,475,346 A 10/1984 Young et al.
5,693,991 A 12/1997 Hiterer et al.
6,050,092 A 4/2000 Genstler et al.
6,199,381 B1 3/2001 Unger et al. ..... 60/520
6,907,730 B2 * 6/2005 Kiikka ..... 60/517
2008/0256945 A1 10/2008 Welty et al.

FOREIGN PATENT DOCUMENTS

EP 1 467 159 10/2004
GB 2 114 673 8/1983
GB 2 136 087 9/1984
JP 58 210379 12/1983
JP 2003-75006 3/2003
JP 2003-314919 11/2003

OTHER PUBLICATIONS

International Search Report and Written Opinion for PCT/GB2005/004957.

* cited by examiner

*Primary Examiner*—Hoang M Nguyen
(74) *Attorney, Agent, or Firm*—Ballard Spahr LLP

(57) ABSTRACT

A linear-free piston Stirling machine comprising a displacer and a power piston. A rod is attached at one end to the displacer, extends through the power piston and is mounted to the casing at its opposite end via a spring. A resilient stopper at the opposite end is arranged to contact the engine casing if the displacement of the displacer exceeds a predetermined limit.

6 Claims, 1 Drawing Sheet

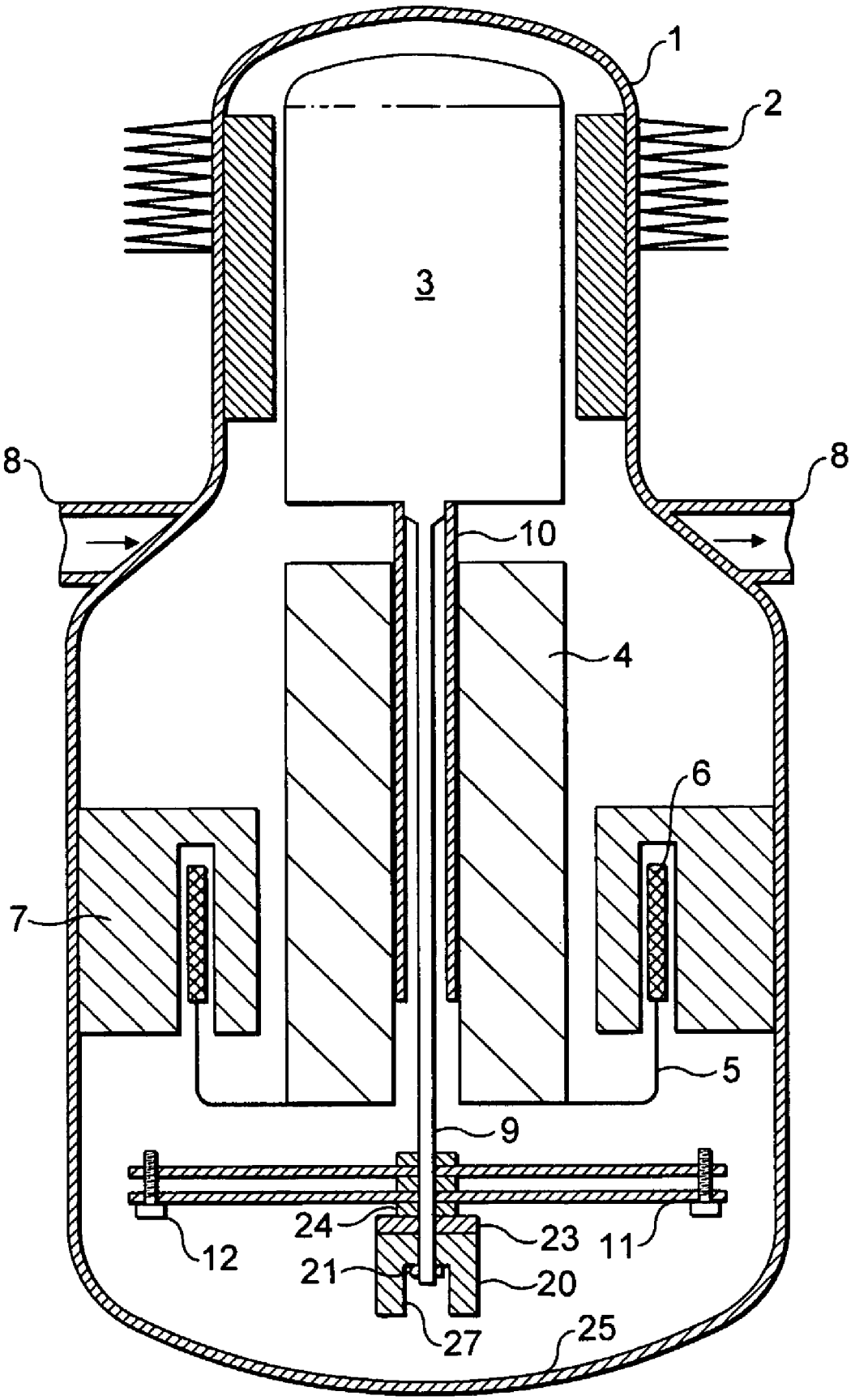
1
2
3
8
8
10
4
6
7
5
9
24
23
11
12
21
20
27
25

LINEAR FREE PISTON STIRLING MACHINE

CROSS-REFERENCE TO RELATED APPLICATIONS

The present application is a National Phase Application of International Application No. PCT/GB2005/004957, filed Dec. 21, 2005, which claims priority to Great Britain Patent Application No. 0428057.4, filed Dec. 22, 2004, which applications are incorporated herein fully by this reference.

The present invention relates to a linear free piston Stirling machine.

Such machines comprise a displacer and a power piston which are reciprocally mounted within a casing, a rod attached at one end to the displacer and extending through an opening in the power piston, and a spring mounted with respect to the casing and being attached to the rod towards its opposite end to reciprocally support the rod and displacer. Such a machine will subsequently be referred to as "of the kind described".

During operation of an engine of the kind described, certain external conditions, such as an increase in power output, will result in the stroke length of the displacer increasing. Also, if the engine is connected to the grid, a variation in mains voltage can cause a change in stroke length.

Any such over stroking of the displacer causes a number of problems. It can cause collisions between the displacer and the power piston, over-extension of the spring causing the premature failure of the spring, or collisions between the rod and the engine casing thereby causing undesirable noise.

According to the present invention, a machine of the kind described is characterised by a resilient stopper on the opposite end of the rod arranged, in use, to contact the engine casing if the displacement of the displacer exceeds a predetermined limit.

The presence of the resilient stopper provides a number of benefits. As the stopper is resilient, it can be designed to come into contact with the engine casing should the displacer piston begin to overstroke. This provides a "soft" interface between the stopper and the casing which limits the degree to which the displacer can overstroke, and reduces noise. The resilient stopper also has a further advantage with regard to engine tuning. During assembly of the engine, tuning to achieve the desired maximum amplitude of reciprocation of the displacer is performed by removing material evenly from the periphery of the stopper. This is easy to achieve with a resilient stopper.

The resilient stopper is typically required to have a mass of some 20% of the displacer mass which may make its overall dimensions too large to be accommodated in the space available. The stopper may therefore comprise a first resilient portion facing the casing, and a denser second non-resilient portion on the side of the resilient portion furthest from the casing. This non-resilient portion can be made, for example, of a metal such as steel, which allows the overall size of the stopper to be reduced for a given mass.

The stopper may be of any suitable resilient material such as foam or plastic, but is preferably rubber. It could also be a spring.

An example of a Stirling machine constructed in accordance with the present invention will now be described with reference to the accompanying drawing which is a schematic cross-section of a Stirling machine. The particular example relates to an engine, but it will be appreciated that the design is equally applicable to other Stirling machines such as motors or coolers.

A linear free piston Stirling machine, in this case an engine, is shown schematically in FIG. 1. The basic design of the engine is well known in the art (for example see page 9, FIG. 2, "Free-Piston Stirling Design Features", Lane, N. W. and Beale, W. T.; 1997 [Review of current design features of free-piston Stirling engines of 3.0 and 1.1 kW output.], available at www.Sunpower.com/technology. Presented at the Eight International Stirling Engine Conference, May 27-30, 1997, University of Ancona, Italy.

In simple terms, the engine has a head 1 having fins 2 which are heated by a burner (not shown). Within the engine housing, are a displacer 3 and a power piston 4 which reciprocate linearly relatively to one another. The power piston 4 is attached to a drum 5 to which magnets 6 are attached. The magnets reciprocate with respect to a stator 7 to provide an electromechanical interface. An intermediate region of the engine is cooled by fluid in a coolant circuit 8.

The displacer 3 has a flexible rod 9 which extends through the centre of the power piston 4, and which is mounted on a pair of planar springs 11. These are bolted by bolts 12 to the engine housing. The top part of the rod 9 is surrounded by an annular sleeve 10 attached to the displacer 3 and which slides within the power piston 4. As the displacer 3 reciprocates the planar springs 11 flex thereby creating a restoring force on the displacer to return it to its equilibrium position.

The improvement provided by the present invention will now be described. A rubber stopper 20 is attached to the end of the rod 9 by a restraining nut 21 screwed onto the rod in a counterbore 22 in the stopper 20. An annular steel mass 23 is sandwiched between the stopper 20 and a washer 24 supporting an adjacent spring 11.

In use, if the displacer 3 begins to overstroke, the stopper 20 will collide with an adjacent portion 25 of the casing thereby limiting the travel of the displacer 3. The impact of the collision will also dampen the displacer motion helping to return the amplitude of reciprocation to within its normal limits. The use of the rubber stopper ensures that no damage will occur to the stopper itself, or to the casing with which it collides. Thus, the use of the stopper allows the springs 10 to operate at their optimal deflection during normal operation. As the optimal spring deflection equates to the maximum spring endurance stress (giving maximum spring life), the stopper maintains the longevity of the springs by preventing damage that could be caused by over extending the springs.

Once a displacer assembly consisting of the displacer 3, flexible rod 9, springs 11 and stopper 20 has been assembled, this can then be tuned. This is done for each individual engine as part of the manufacturing process. The displacer assembly is placed in a dedicated tuning rig and is reciprocated at its natural frequency. The tuning is then performed by removing material from the stopper 20 until the desired amplitude of reciprocation is achieved. This can be done remotely and incrementally. The displacer assembly is then dismantled so that it can be reassembled together with the remainder of the engine components. This tuning process allows the small differences between engines, which are unavoidable due to accumulated effects of manufacturing tolerances, to be tuned out of the design during assembly.

If the stopper is replaced by a spring, this would be tuned by being progressively shortened. If the spring is metal, it may be more resistant to deforming over time, and avoids the potential for small rubber particles to become loose in the casing.

If acceptable manufacturing tolerances can be achieved, it may be unnecessary to tune each assembly. Instead, random samples may be tested to ensure adequate quality control.

The invention claimed is:

1. A linear free piston Stirling machine comprising a displacer and a power piston which are reciprocally mounted within a casing, a rod attached at one end to the displacer and extending through an opening in the power piston, and a spring mounted with respect to the casing and being attached to the rod towards its opposite end to reciprocally support the rod and displacer; characterised by a resilient stopper separate from the spring on the opposite end of the rod arranged, in use, to contact the engine casing if the displacement of the displacer exceeds a predetermined limit.

2. A machine according to claim 1, wherein the stopper comprises a first resilient portion facing the casing, and a denser second non-resilient portion on the side of the resilient portion furthest from the casing.

3. A machine according to claim 1, wherein the stopper is rubber.

4. A machine according to claim 1, wherein the stopper is a spring.

5. A machine according to claim 2, wherein the stopper is rubber.

6. A machine according to claim 2, wherein the stopper is a spring.

* * * * *